US007677319B2

(12) United States Patent
Baskett

(10) Patent No.: US 7,677,319 B2
(45) Date of Patent: Mar. 16, 2010

(54) SUBSEA TREE CAP AND METHOD FOR INSTALLING THE SUBSEA TREE CAP

(75) Inventor: David Baskett, Houston, TX (US)

(73) Assignee: Aker Subsea, Inc., Houston, TX (US)

( * ) Notice: Subject to any disclaimer, the term of this patent is extended or adjusted under 35 U.S.C. 154(b) by 146 days.

(21) Appl. No.: 11/873,206

(22) Filed: Oct. 16, 2007

(65) Prior Publication Data

US 2008/0087436 A1 Apr. 17, 2008

Related U.S. Application Data

(60) Provisional application No. 60/852,024, filed on Oct. 16, 2006.

(51) Int. Cl.
*E21B 34/04* (2006.01)
*E21B 41/04* (2006.01)

(52) U.S. Cl. ..... 166/360; 166/368

(58) Field of Classification Search ..... 166/339, 166/341, 360, 368, 75.11, 75.13, 79.1, 97.1, 166/86.2, 88.3, 88.4, 97.5
See application file for complete search history.

(56) References Cited

U.S. PATENT DOCUMENTS 5,992,526 A 11/1999 Cunningham
6,276,162 B1 8/2001 Schemel
6,681,850 B2 * 1/2004 Bartlett et al. ..... 166/86.2
2002/0088622 A1 7/2002 Beall et al.
2002/0185279 A1 12/2002 Blair et al.
2004/0216885 A1 * 11/2004 Bartlett ..... 166/343

OTHER PUBLICATIONS

International Search Report and Written Opinion from related pending case No. PCT/US2007/81523.

* cited by examiner

*Primary Examiner*—David J Bagnell
*Assistant Examiner*—Benjamin Fiorello
(74) *Attorney, Agent, or Firm*—Zarian Midgley & Johnson, PLLC

(57) ABSTRACT

A retrievable tree cap for use on a subsea tree having a concentric bore. The tree cap may be installed and retrieved using a remotely operated vehicle. Hydraulic pressure may be used to lock the tree cap onto the subsea tree and to set the tree cap seals. The tree cap is locked onto the subsea tree before setting the seals within the concentric bore. The tree cap includes a locking means that may engage a profile within the subsea tree regardless of the radial orientation of the tree cap. The tree cap may be used to hydraulically isolate an annulus bore from the production bore of the subsea tree. The tree cap may provide for the injection of a corrosion inhibitor within a cavity of the tree cap and may also provide for the removal of water trapped between the tree cap and the subsea tree.

27 Claims, 11 Drawing Sheets

SUBSEA TREE CAP AND METHOD FOR INSTALLING THE SUBSEA TREE CAP

CROSS REFERENCE TO RELATED APPLICATION

This application claims the benefit of U.S. Provisional App. No. 60/852,024 entitled "SUBSEA ROV RETRIEVABLE TREE CAP," filed on Oct. 16, 2006, by David Baskett, which is incorporated in its entirety herein.

BACKGROUND OF THE INVENTION

1. Field of the Invention

The present invention generally relates to a retrievable tree cap for use on a concentric bore "conventional" or "vertical" subsea tree. The tree cap may be installed and retrieved using a remote operated vehicle (ROV). The tree cap may include buoyant material, such as syntactic foam, to decrease the submerged weight of the tree cap. The buoyant material may be configured to orient the tree cap in a vertical position when submerged. The tree cap may include a foldable handle that may be used by the ROV to transport the tree cap. The ROV may be used to move the handle from a vertical position to a horizontal position after the tree cap has been installed into the subsea tree. The tree cap may include a hot stab injector that the ROV may remove from the tree cap after installation of the tree cap.

The tree cap may be landed into the concentric bore of a subsea tree and locked in place before setting the seals within the bore. A plurality of seals of the tree cap may be used to hydraulically isolate the annulus bore from the production bore of the tree spool. A hot stab injector may be used to apply fluid pressure to the tree cap to first engage a first locking mechanism to selectively lock the tree cap to the subsea tree and to then the pressure may be used to set or energize a plurality of seals within the bore of the subsea tree. A second locking mechanism may be used to selectively secure a seal carrier in a lower position wherein the plurality of seals isolate the production and annulus bores of the subsea tree.

The tree cap may further include means for injecting a corrosion inhibitor within a cavity of the tree cap. The tree cap may include a flow path and valve, such as a p-trap vent or one-way check valve, which permits the removal of water trapped between the tree cap and the subsea tree. The tree cap may also include a flow path that may be used to pressure test the seals on the seal carrier. The tree cap may be adapted to permit a first locking means to engage a profile of the subsea tree regardless of the radial orientation of the tree cap.

2. Description of the Related Art

A wellhead assembly, such as that employed on the seabed for offshore drilling and production operations, may often include a "conventional" or "vertical" subsea tree used to access the well bore. The subsea tree includes a bore that may be sealed off or isolated using a tree cap. Typically the subsea tree includes a production bore as well as an annulus bore that may be isolated with the insertion of a tree cap. Prior tree caps generally require the specific radial alignment of the tree cap in order to be inserted and secured in the subsea tree. The alignment of the tree cap to a particular radial alignment may be difficult when installing the tree cap with a ROV. It would thus be beneficial to provide a tree cap that may be installed into a subsea tree at any radial orientation.

While installing a tree cap in a subsea tree one potential problem is damaging the seals during the installation process. The seals are the key component to the tree cap so it is important to prevent damage to the seals during the installation process. It would thus be beneficial to provide a tree cap that may be installed and selectively secured to a subsea tree before the seals are set.

The installation of a tree cap on a subsea tree spool can be difficult. A ROV may be used to install the tree cap. It would thus be beneficial to provide a light weight tree cap to facilitate the installation of the tree cap by a ROV. The tree cap may have integral buoyancy to regulate wet weight. The tree cap may have integral buoyancy to help the underwater transport of the tree cap. It may be also beneficial to have integral buoyancy that is configured to orient the tree cap in an upright position when submerged.

Fluid may become trapped within the cavity of the tree cap while the tree cap is installed onto a tree spool. This may be problematic for a light weight tree cap as the fluid may prevent the tree cap from properly landing on the tree spool. Further, the water may cause corrosion of some of the internal parts of the tree cap and subsea tree system such as the VX gasket. It would be beneficial to provide means for releasing trapped fluid from within the cavity of the tree cap. Further, it would be beneficial if this means also allowed for the injection of a corrosion inhibitor within the tree cap.

In light of the foregoing, it would be desirable to provide a tree cap that may be installed in a concentric bore of a subsea tree at any radial orientation of the tree cap. It would also be beneficial to provide a tree cap with integral buoyancy to reduce the submerged weight of the tree cap. It would be beneficial to provide a tree cap that may be selectively secured to a subsea tree prior to setting the seals to isolate the production and isolation bore. It would be beneficial to provide a tree cap that may be first locked to the subsea tree by the application of hydraulic pressure and then may set the seals to isolation the production and annulus bores by the continual application of hydraulic pressure. It would be beneficial to provide a tree cap that orients itself in an upright position when submerged. It would be beneficial that provides a tree cap that permits the removal of water trapped between the tree cap and the subsea tree. It would also be beneficial to provide a tree cap that permits the pressure testing of the seals of the seal carrier.

The present invention is directed to overcoming, or at least reducing the effects of, one or more of the issues set forth above.

SUMMARY OF THE INVENTION

The object of the present disclosure is to provide a tree cap for a subsea tree having an annulus bore and a production bore that may be installed and retrieved using an ROV. In one embodiment, the tree cap includes a cylindrical body that has an upper end and a lower end. The cylindrical body includes a longitudinal flow path along the body having an upper fluid port and a lower fluid port. The tree cap includes a cap that is connected to the upper end of the cylindrical body. The cap includes an opening through which a retaining sleeve may be positioned. A rod is positioned through the retaining sleeve and extends into the cylindrical body. The upper portion of the rod extends above the cap and may be used to determine when the seal carrier, discussed below, is located in its lower or second position. The rod may include at least one radial port, a longitudinal flow path along the rod, and a p-trap vent or one-way check valve at the top end of the longitudinal flow path. The tree cap includes a plate connected to the cylindrical body and syntactic foam connected to the plate. The syntactic foam may include an upper portion connected to the top of the plate and a lower portion connected to the bottom of the plate.

The tree cap includes a cam that is adapted to engage a portion of the rod. The cam is positioned within the cylindrical body. A spring is positioned around the rod applying a downward force on the cam. The spring is biased to move the cam and the rod from an upper position to a lower position. A lower locking mechanism, such as a locking dog, retains the cam and rod in the upper position while the tree cap is inserted into the subsea tree. The lower locking mechanism is movable between an inner position, which prevents the downward movement of the cam and rod, to an outer position that permits the downward movement of the cam and rod. A seal carrier selectively retains the lower locking mechanism in its inner position until setting the tree cap seals in the bore of subsea tree. Various configurations and actual locking means may be used to selectively retain the cam and rod in its upper position as would be appreciated by one of ordinary skill in the art having the benefit of this disclosure.

The tree cap includes a seal carrier that is slideably connected to the cylindrical body. The seal carrier includes an upper seal and a lower seal and the seal carrier may be selectively moved between a first position and a second position. The upper and lower seals may be metal-to-metal seals. The seal carrier may also include at least one elastomeric seal adjacent to each of the upper and lower seals. In the first position, the seal carrier retains the lower locking mechanism in its inner position. In the second position, the seal carrier releases the lower locking mechanism and the upper seal and lower seal of the seal carrier are positioned to isolate the annulus bore from the production bore.

The tree cap includes a sleeve and a housing around the sleeve creating a cavity between the sleeve and the housing. The sleeve includes an upper sealing element and a lower sealing element and is slideably connected to the upper end of the cylindrical body. The sleeve may include an outer sealing element that provides a seal against the housing. The sleeve may be moved between a first position, a second position, and a third position. In the first position and the second position, the upper and lower sealing elements of the sleeve hydraulically isolate the upper fluid port of the cylindrical body. In the third position, the upper sealing element of the sleeve moves below the upper fluid port of the cylindrical body permitting fluid communication between the cavity and the upper fluid port.

The tree cap includes an upper locking mechanism, such as a locking dog, that may be selectively moved between an inner position and an outer position. The upper locking mechanism is biased to its inner position and is adapted to engage a profile in the subsea tree when moved to its outer position. Various configurations and actual locking means may be used to selectively engage a profile in the subsea tree as would be appreciated by one of ordinary skill in the art having the benefit of this disclosure. The upper locking mechanism may be adapted to selectively engage the profile in the subsea tree regardless of the radial orientation of the tree cap. This may eliminate the need for the ROV to rotate and align the tree cap to a specified orientation prior to installation into the subsea tree.

The tree cap includes a hot stab injector that may be selectively connected to the plate. The hot stab injector is in fluid communication with the cavity between the housing and the sleeve. Fluid pressure may be applied through the hot stab injector to move the sleeve from the first position to the second position. In the second position, the sleeve forces the upper locking dog to its outer position engaging the profile to selectively lock the tree cap to the subsea tree. Fluid pressure may be continually applied through the hot stab injector to move the sleeve to a third position, which moves the upper sealing element past the upper fluid port of the cylindrical body allowing fluid pressure to enter the upper fluid port. The fluid pressure may then be applied to the seal carrier from the lower fluid port causing the seal carrier to move to its second position. In the second position, the upper and lower seals are positioned in the seal bore of the subsea tree to hydraulically isolate the production and annulus bores. The movement of the seal carrier to the second position permits the outward movement of the lower locking dogs, which permits the downward movement of the cam and rod to selectively retain the seal carrier in its second position. The hot stab injector may be used to inject a corrosion inhibitor into the cavity between the tree cap and the subsea tree. The ROV may be used to remove the hot stab injector after the seal carrier has been moved to its second or lower position.

The tree cap may also include a centralizer connected to the bottom of the seal carrier. The tree cap may include a handle that is connected to the upper end of the cylindrical body. The ROV may be able to move the handle from an upright vertical position to a lower horizontal position after the seals have been set to isolate the production and annulus bores.

Another embodiment is a tree cap for installation in a subsea tree that has an annulus bore and a production bore. The tree cap includes a cap, a cylindrical body that is connected to the cap, and hydraulically actuated means for selectively locking the cylindrical body to a profile in the subsea tree. Means for selectively locking the cylindrical body may include locking dogs, collets, spring loaded pins, split rings or collars, or any other equivalent structure that may be used to selectively engage a profile as would be appreciated by one of ordinary skill in the art having the benefit of this disclosure. The tree cap also includes a seal carrier that is slideably connected to the cylindrical body. The seal carrier may be moved between a non-actuated position and an actuated position. In the actuated position, seals on the seal carrier hydraulically isolate the annulus bore and the production bore of the subsea tree. The tree cap includes means for hydraulically moving the seal carrier to the actuated position after locking the cylindrical body to the profile. The tree cap may include means for selectively locking the seal carrier in the actuated position. Means for selectively locking the seal carrier in the actuated position may include locking dogs, collets, spring loaded pins, split rings or collars, or any other equivalent structure as would be appreciated by one of ordinary skill in the art having the benefit of this disclosure.

Another embodiment is a method for installing a tree cap on a subsea tree including moving the tree cap to the subsea tree with a remotely operated vehicle and inserting the tree cap into a bore in the subsea tree. The method includes applying fluid pressure to the tree cap with a hot stab injector selectively connected to the tree cap and locking the tree cap into the subsea tree. After the tree cap is locked to the subsea tree, the method includes setting the seals of the tree cap to isolate the production and annulus bores of the subsea tree. The method may include injecting a corrosion inhibitor through the hot stab injector into a cavity between the tree cap and the subsea tree. The method may also include removing water trapped between the tree cap and the subsea tree. An ROV may be used to move a handle of the tree cap from a vertical position to a horizontal position and to remove the hot stab injector.

One embodiment is a tree cap for use with a subsea tree having a concentric bore. The tree cap includes a cylindrical body having a top end and a bottom end and a cap connected to the top end of the cylindrical body. The tree cap includes a seal carrier that is slideably connected to the bottom end of the cylindrical body. The seal carrier is movable between an upper position and a lower position and includes a plurality of seals that are adapted to seal the concentric bore of the subsea tree when the seal carrier is located in its lower position. The tree cap includes a first locking means that is connected to the cylindrical body. The first locking means is adapted to selectively engage a profile within the concentric bore of the subsea tree. The first locking means may engage the profile regardless of the radial orientation of the cylindrical body of the tree cap. The tree cap includes a second locking means that is connected to the cylindrical body. The second locking means is adapted to selectively retain the seal carrier in its lower position. The tree cap includes a hot stab injector. Fluid pressure may be applied from the hot stab first to have the first locking means engage the profile. After the first locking means has engaged the profile, fluid pressure applied from the hot stab may move the seal carrier to its lower position. The second locking means may then be used to selectively retain the seal carrier in the lower position. It the lower position, the plurality of seals of the seal carrier hydraulically isolates the concentric bore of the subsea tree.

Figure 1:
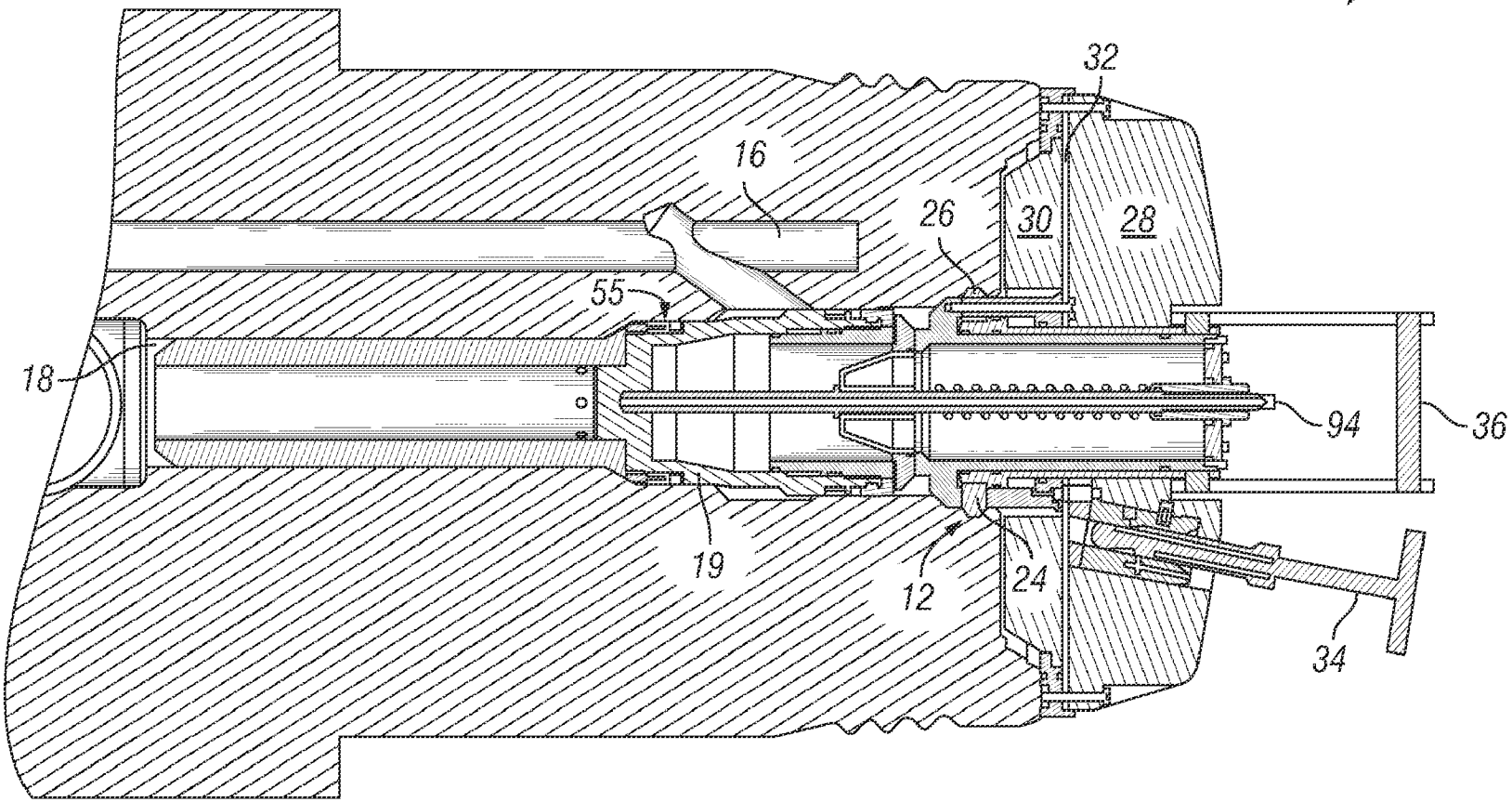
FIG. 1 shows a cross-section view of one embodiment of a tree cap inserted into a subsea tree.

While the invention is susceptible to various modifications and alternative forms, specific embodiments have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DESCRIPTION OF ILLUSTRATIVE EMBODIMENTS

Illustrative embodiments of the invention are described below as they might be employed in tree cap that may be installed and removed on a subsea tree by a ROV. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Further aspects and advantages of the various embodiments of the invention will become apparent from consideration of the following description and drawings.

FIG. 1 shows a cross-section view of one embodiment of a tree cap 1 inserted into the bore of a subsea tree 14. The subsea tree 14 includes a production bore 18 and an annulus bore 16. The subsea tree 14 includes a seal bore 55 in which the seals of the tree cap 1 may hydraulically isolate the production and annulus bores 16, 18. The tree cap 1 as depicted in FIG. 1 is locked within the subsea tree 14 with locking dogs 24, 26 extended into a lock profile 12 of the subsea tree 14. FIGS. 1 depicts the seals of a seal carrier 19 positioned within the subsea tree 14 to hydraulically isolate the production bore 18 and the annulus bore 16. The various components and operation of the tree cap 1 will be discussed in detail below.

Figure 2:
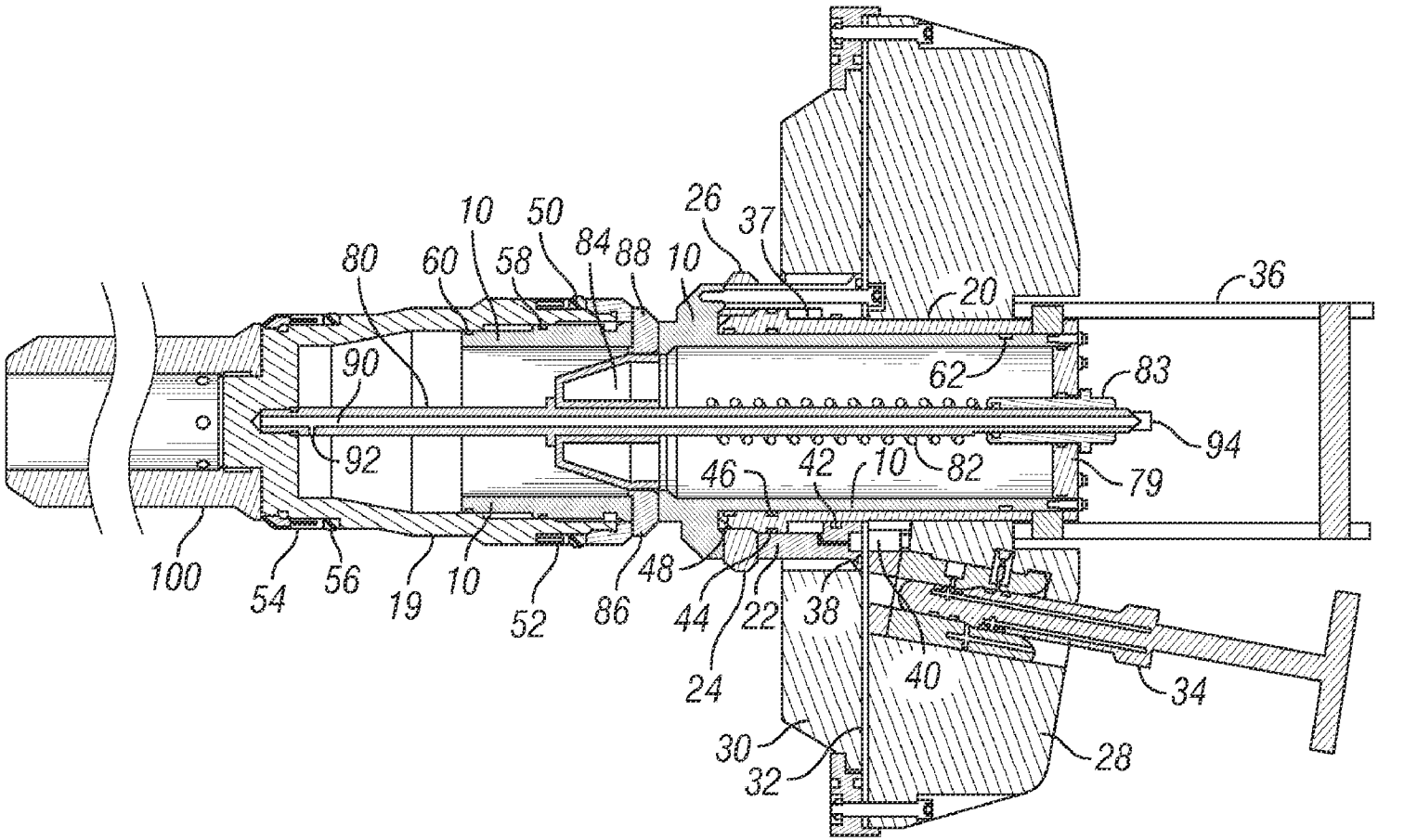
FIG. 2 shows a cross-section view of one embodiment of a tree cap.
Figure 8:
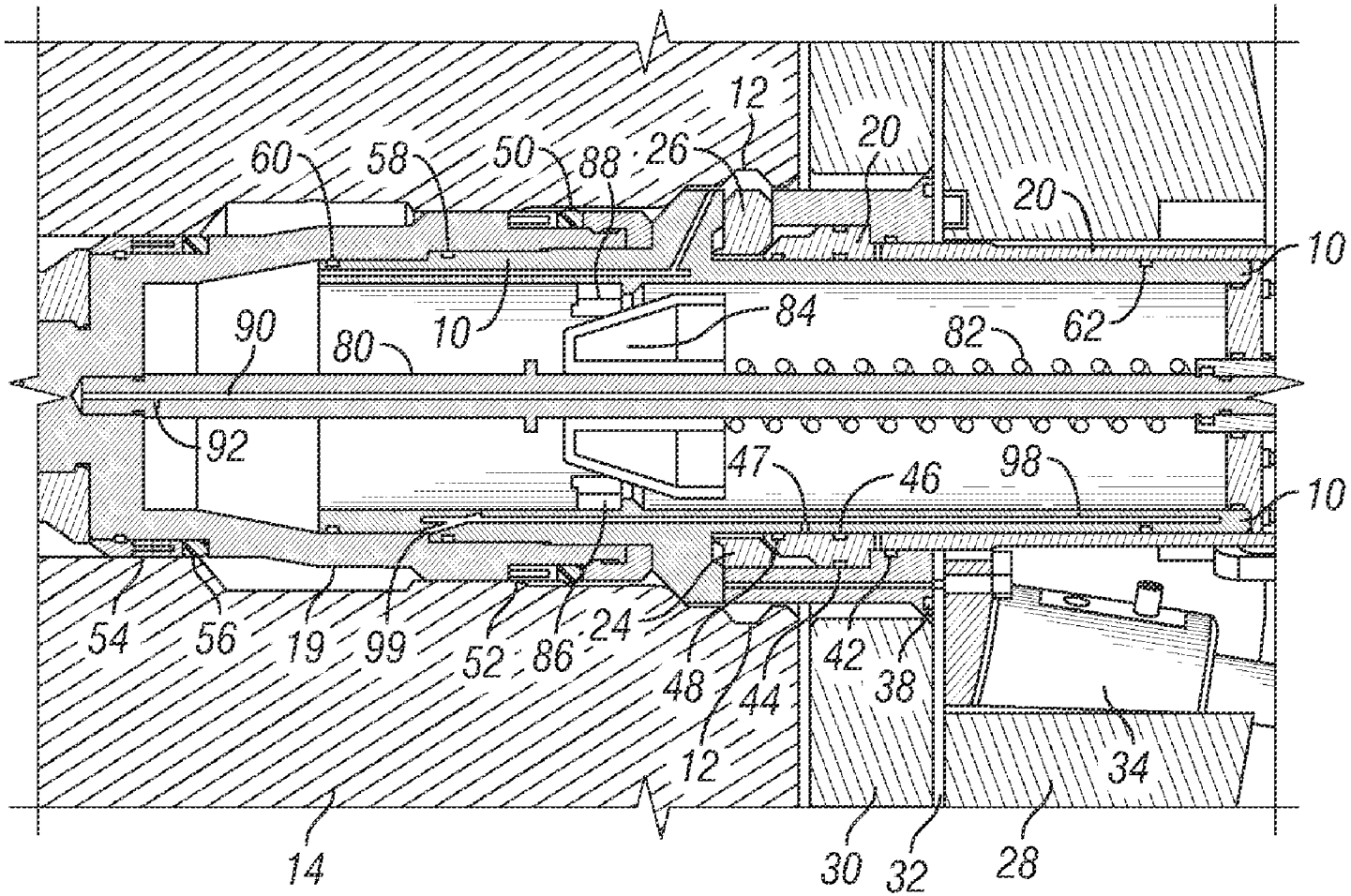
FIG. 8 shows a cross-section view of one embodiment of a tree cap before the tree cap is locked into the subsea tree.

FIG. 2 shows a cross-section view of one embodiment of a tree cap 1. The tree cap 1 has a cylindrical body 10 and a cap 79 connected to the top of the cylindrical body 10. The majority of the components of the tree cap 1 may be comprised of metal such as stainless steel and 80 ksi LAS. The sealing elements may be comprised of nitrile seals. A rotatable handle 36 may be connected to the cap 79 or the cylindrical body 10. The handle 36 may be rotated between an upright position (shown in FIG. 2) to a horizontal position (shown in FIG. 11), which reduces the profile of the tree cap 1. The reduced profile may decrease the risk of equipment snagging on the installed tree cap 1. The cap 79 includes an opening through which a retainer sleeve 83 may be positioned. A rod 80 may be positioned within a longitudinal bore of the retaining sleeve 83. The rod 80 includes at least one radial port 92 and a longitudinal port 90 that may be used to expel water trapped between the tree cap 1 and the subsea tree 14. The upper end of the longitudinal port 90 includes a p-trap vent 94 to prevent fluid from flowing down the longitudinal port 90. Alternatively, other devices the allow fluid to flow through it in only one direction, such as a check valve, may be used at the end of the longitudinal port 90 as would be appreciated by one of ordinary skill in the art having the benefit of this disclosure. A spring 82 is positioned around the rod 80. One end of the spring is connected to or retained by the retaining sleeve 83. The other end of the spring 82 engages a cam 84. The cam 84 is movable between a first or upper position and a second or lower position. FIG. 2 depicts the cam 84 in the second or lower position. While the cam 84 is retained in this first or upper position the spring 82 is compressed between the cam 84 and the retaining sleeve 83 and thus, exerts a downward force on the cam 84. Locking dogs 86, 88 may be used to selectively retain the cam 84 in its first or upper position compressing the spring 82 as shown in FIG. 8. The locking dogs 86, 88 may be comprised of 105 ksi LAS. The operation of the locking dogs 86, 88 with respect to the cam 84 will be discussed in detail below.

A plate 32 is connected to the cylindrical body 10 with upper syntactic foam 28 connected to the top of the plate 32 and lower syntactic foam 30 connected to the bottom of the plate 32. The syntactic foam may provide buoyancy to the tree cap 1 reducing the submerged weight of the tree cap 1. The configuration of the syntactic foam may also provide that the tree cap 1 orients itself in an upright position when submerged. The reduced weight and upright orientation of the tree cap 1 while submerged may aid in the transportation of the tree cap 1 by an ROV to the location of a subsea tree 14.

A seal carrier 19 having a plurality of seals is slideably connected to the cylindrical body 10. The seal carrier 19 includes an upper seal 52 and a lower seal 54 that are used to hydraulically isolate the production and annulus bores 16, 18 of the subsea tree 14. The upper and lower seals 52, 54 may be metal-to-metal seals. The tree cap 1 may include elastomeric seals 50, 56, such as o-rings, located adjacent to the upper and lower seals 52, 54. The elastomeric seals may provide a secondary seal to the upper and lower seals 52, 54. The seal carrier 19 may include an upper outer diameter seal 58 and a lower outer diameter seal 60 to provide a seal between the seal carrier 19 and the cylindrical body 10. The upper outer diameter seal 58 and the lower diameter seal 60 may be various elastomeric seals, such as an o-ring, as would be appreciated by one of ordinary skill in the art having the benefit of this disclosure. The seal carrier 19 is movable between an upper or first position and a lower or second position along the cylindrical body 10 as will be discussed in more detail below. A centralizer 100 may be connected to the bottom of the seal carrier 19 to help center the tree cap 1 within the production bore 18 of the subsea tree 14.

The tree cap 1 includes a movable piston 20 positioned in a cavity located between a dog housing 22 and the cylindrical body 10. The dog housing 22 may include a sealing element 38 to seal the interface between the dog housing 22 and the plate 32. Pressure may be applied to the cavity from a hot stab injector 34 positioned through the upper syntactic foam 28. The hot stab injector 34 is in fluid communication with the cavity between the dog housing 22 and the cylindrical body 10. The tree cap 1 may include a hydraulic port 40 adjacent to the hot stab injector 34 and in communication with the cavity. Pressure may be applied to the cavity to move the piston 20 downwards along the cylindrical body 10. The downward movement of the piston 20 moves locking dogs 24, 26 outwards into the locking profile 12 of the subsea tree 14 selectively locking the tree cap 1 to the subsea tree 14.

The piston 20 includes an upper inner seal 46 and a lower inner seal 48 that may be positioned to isolate an upper hydraulic port 47 in the cylindrical body 10 from the hydraulic pressure within the cavity. The piston 20 may include an upper outer sealing element 42 and a lower outer sealing element 44 to seal the interface between the piston 20 and the dog housing 22. The piston 20 may also include an upper barrier seal 62 between the piston 20 and the cylindrical body 10. The pressure may increased within the cavity to move the piston 20 to first engage the profile with the locking dogs 24, 26 and then to move the piston 20 downwards until upper inner seal 46 travels past the upper hydraulic port 47 permitting hydraulic communication with a lower hydraulic port 99 (shown in FIG. 8) of the cylindrical body 10. A locking piston valve 37 may be used to lock the piston 20 and locking dogs 24, 26 in the locked position.

Figure 3:
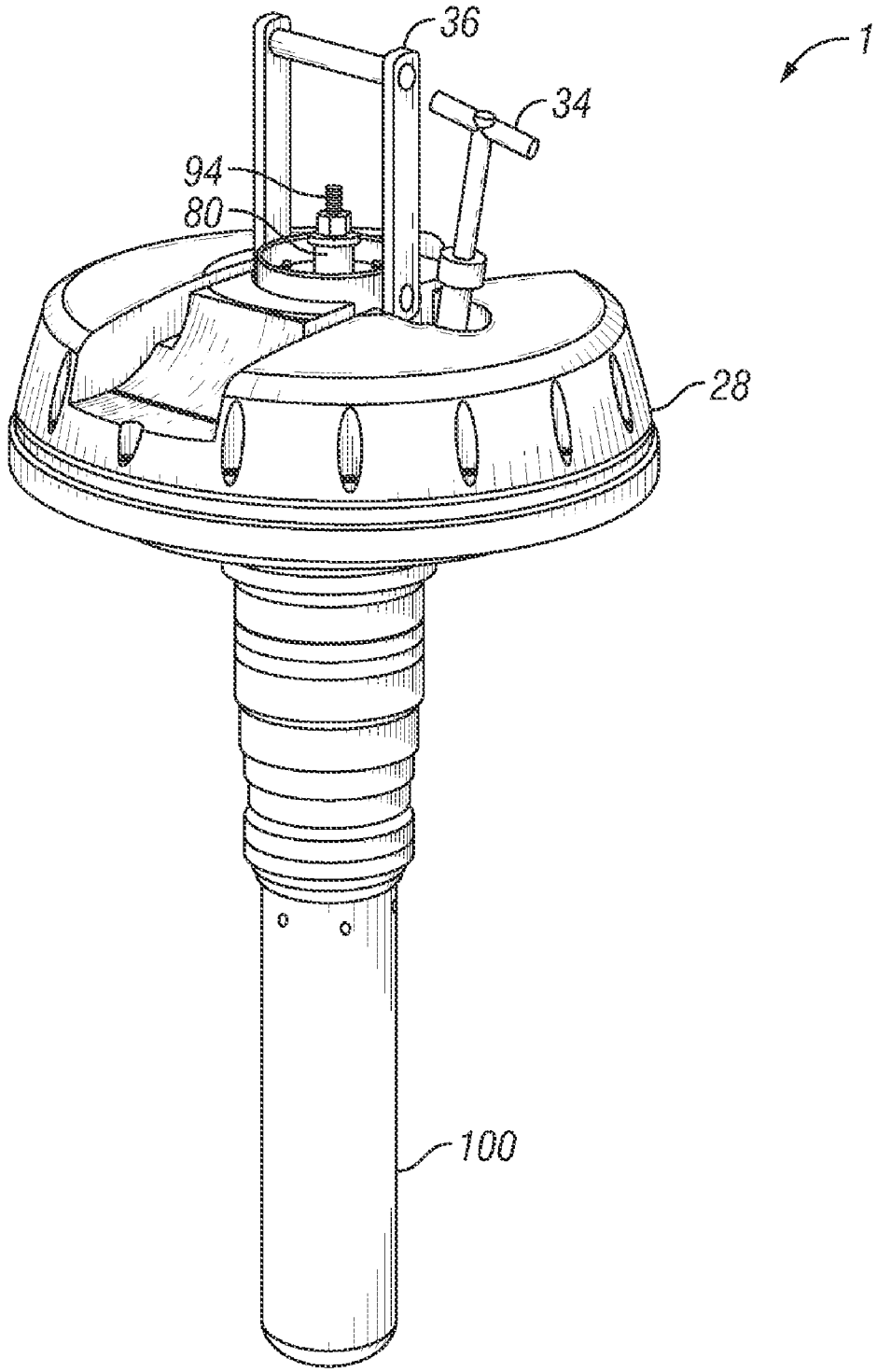
FIG. 3 shows a perspective view of one embodiment of a tree cap.
Figure 5:
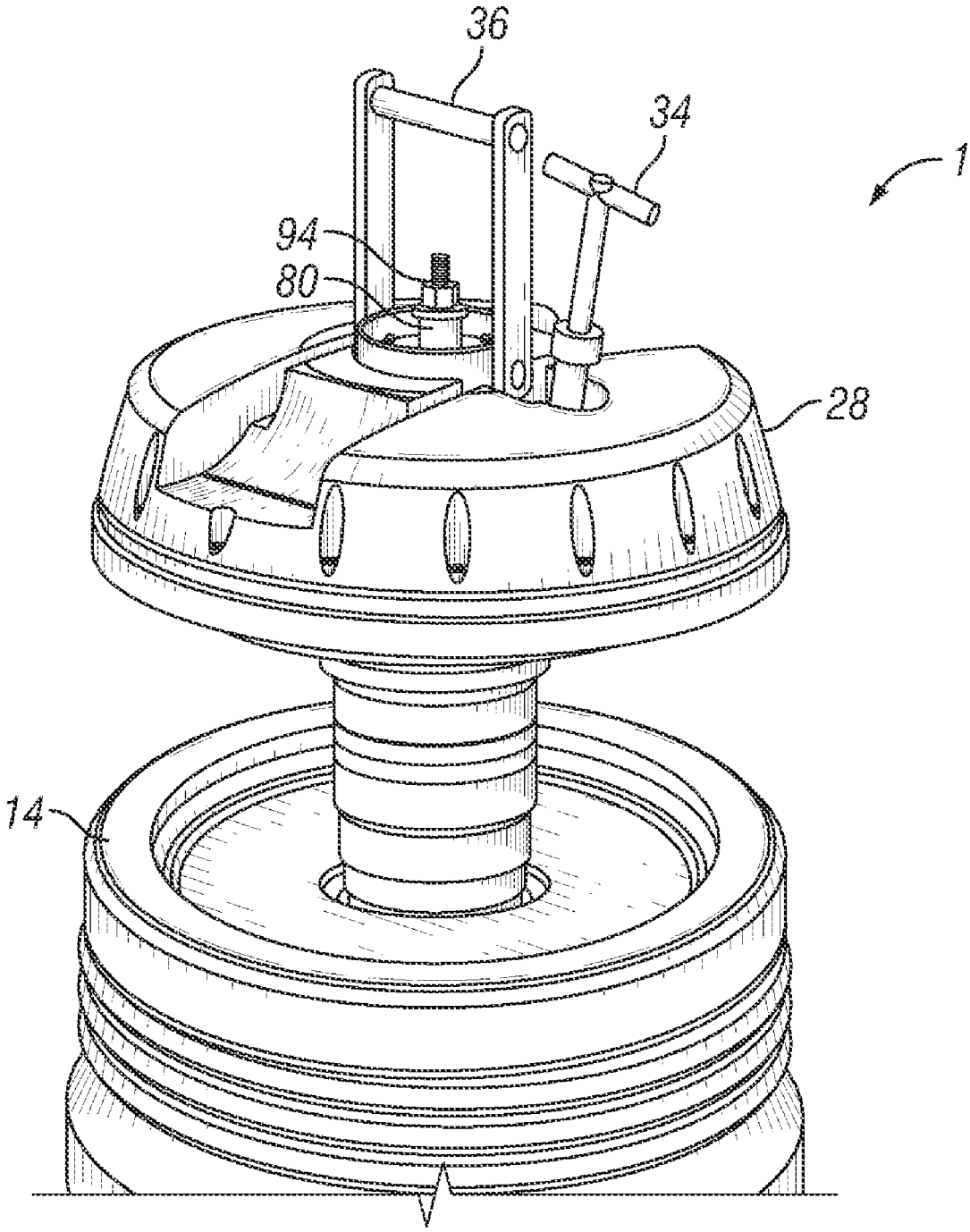
FIG. 5 shows a perspective view of one embodiment of a tree cap partially inserted into a subsea tree.
Figure 11:
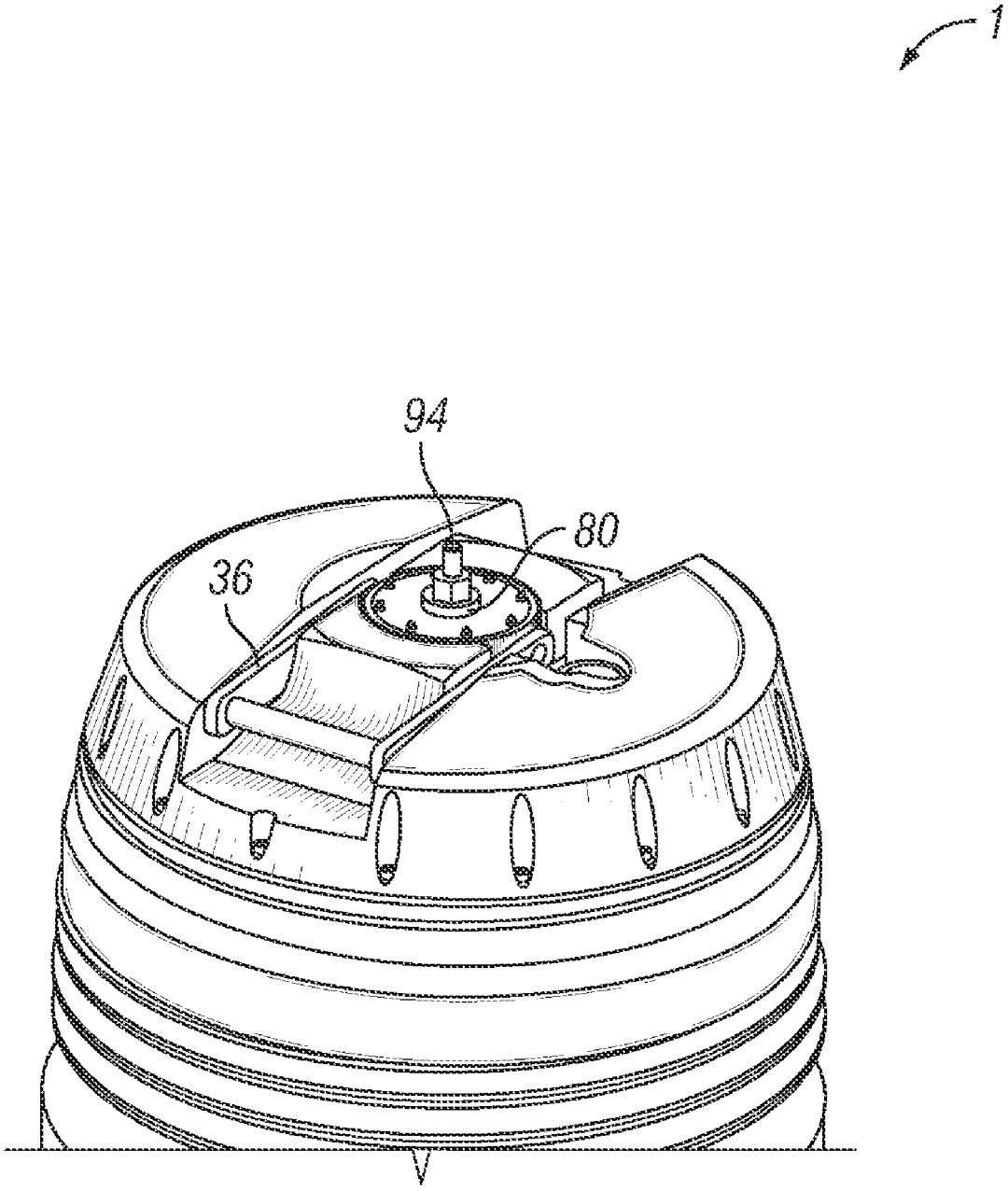
FIG. 11 shows a perspective view of one embodiment of a tree cap with a rotatable handle folded down to a horizontal position.

FIG. 3 shows a perspective view of one embodiment of a tree cap 1 that includes a centralizer 100 connected to the seal carrier 19. The centralizer 100 may be comprised of a material that may help prevent damage to the production bore as the tree cap is inserted such as UHMW or Delrin plastic. An upper portion of syntactic foam 28 is connected to the plate 32, which may reduce the submerged weight of the tree cap 1. A hot stab injector 34 is disposed in the syntactic foam 28. A portion of the rod 80 protrudes out of the tree cap 1 and may be used to visually indicate the position of the seal carrier 19. A p-trap vent 94 may be attached to the end of the rod 80 and may be used to prevent fluid flow down a longitudinal bore in the rod 80. FIG. 3 shows the rotatable handle 36 in an upright position, which may be used by an ROV to handle the tree cap 1. FIG. 5 shows a perspective view of the tree cap 1 being inserted into the bore of a subsea tree 14. FIG. 11 shows a perspective view of the tree cap 1 inserted into the subsea tree 14. The handle 36 has been folded into a horizontal position reducing the overall profile of the tree cap 1. The reduction of the profile decreases the probability that equipment may become snagged or caught on the installed tree cap 1. The shorter length of rod 80 protruding from the tree cap 1 (with respect to FIG. 5) indicates that the seals of the seal carrier 19 have been set within the seal bore 55 of the subsea tree 14.

Figure 4:
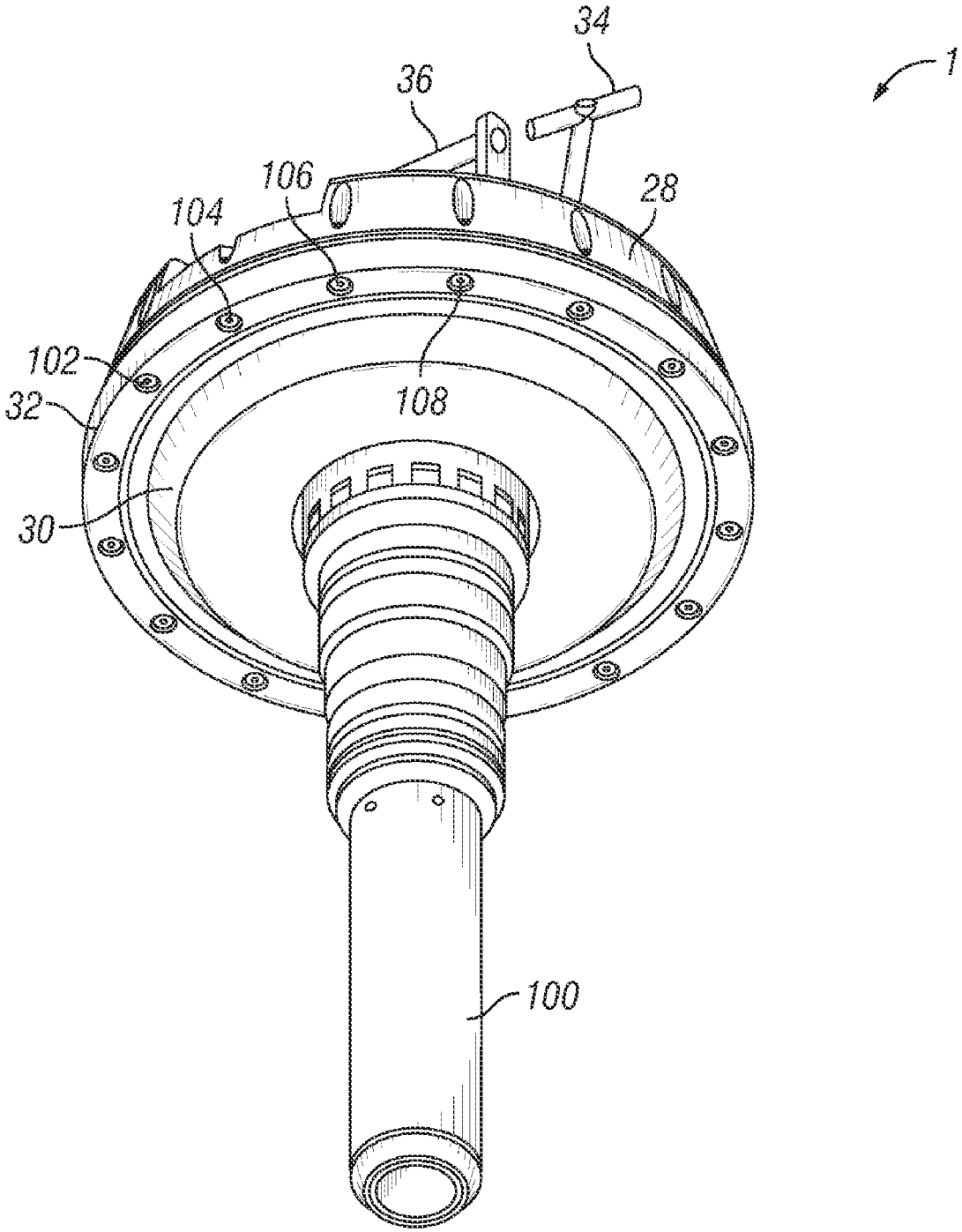
FIG. 4 shows a bottom perspective view of one embodiment of a tree cap.
Figure 6:
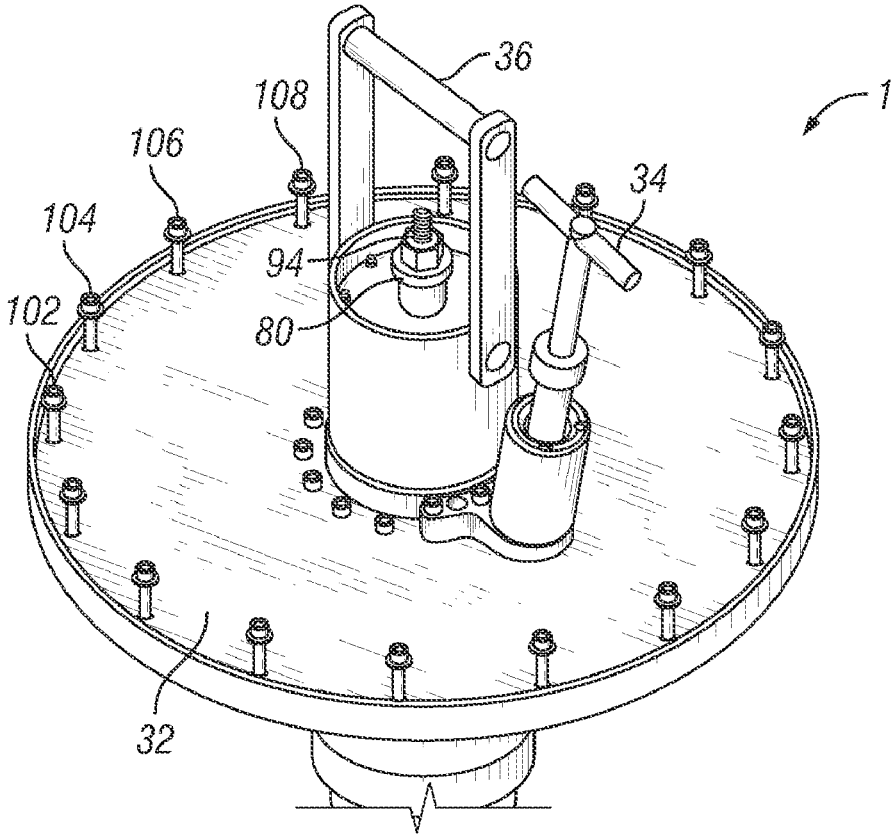
FIG. 6 shows so a top perspective view of one embodiment of a tree cap without any syntactic foam attached to the top of the tree cap.
Figure 7:
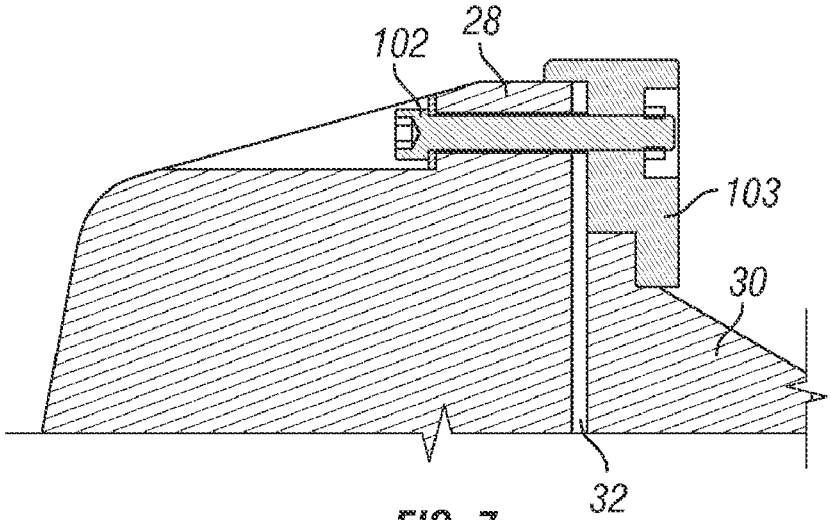
FIG. 7 shows a cross-section view of a portion of one embodiment of a tree cap depicting the attachment of syntactic foam to the upper and lower portion of the tree cap plate.

FIG. 4 shows a bottom perspective view of one embodiment of a tree cap 1. Fasteners 102, 104, 106, 108 may be used to secure the upper syntactic foam 28 to the plate 32. The lower syntactic foam 30 may help to decrease the submerged weight of the tree cap 1 and may be configured in combination with the upper syntactic foam 28 to help orient the tree cap 1 in an upward position when submerged. FIG. 7 shows a cross-section view of one embodiment of a fastener 102 and bracket 103 used to secure the upper and lower syntactic foam 28, 30 to a plate 32. FIG. 6 shows a perspective view of the tree cap 1 with the upper syntactic foam 28 removed from the plate 32 and fasteners 102, 104, 106, 108.

FIG. 8 shows a cross-section view of one embodiment of the tree cap 1 before the tree cap 1 has been selectively locked to the subsea tree 14. Locking dogs 24, 26 are retracted to their inner or first position and have not yet engaged the locking profile 12 of the subsea tree 14. The spring 82 is in a compressed state between the cam 84 and the retainer sleeve 83 as the lower locking dogs 86, 88 prevent the downward movement of the cam 84. The seal carrier 19 is positioned in its upper or first position and prevents the lower locking dogs 86, 88 from extending outward to release the cam 84. Pressure may be applied from a hot stab injector 34 to move the piston 20 down the cylindrical body 10 to selectively lock the tree cap 1 to the subsea tree 14.

Figure 9:
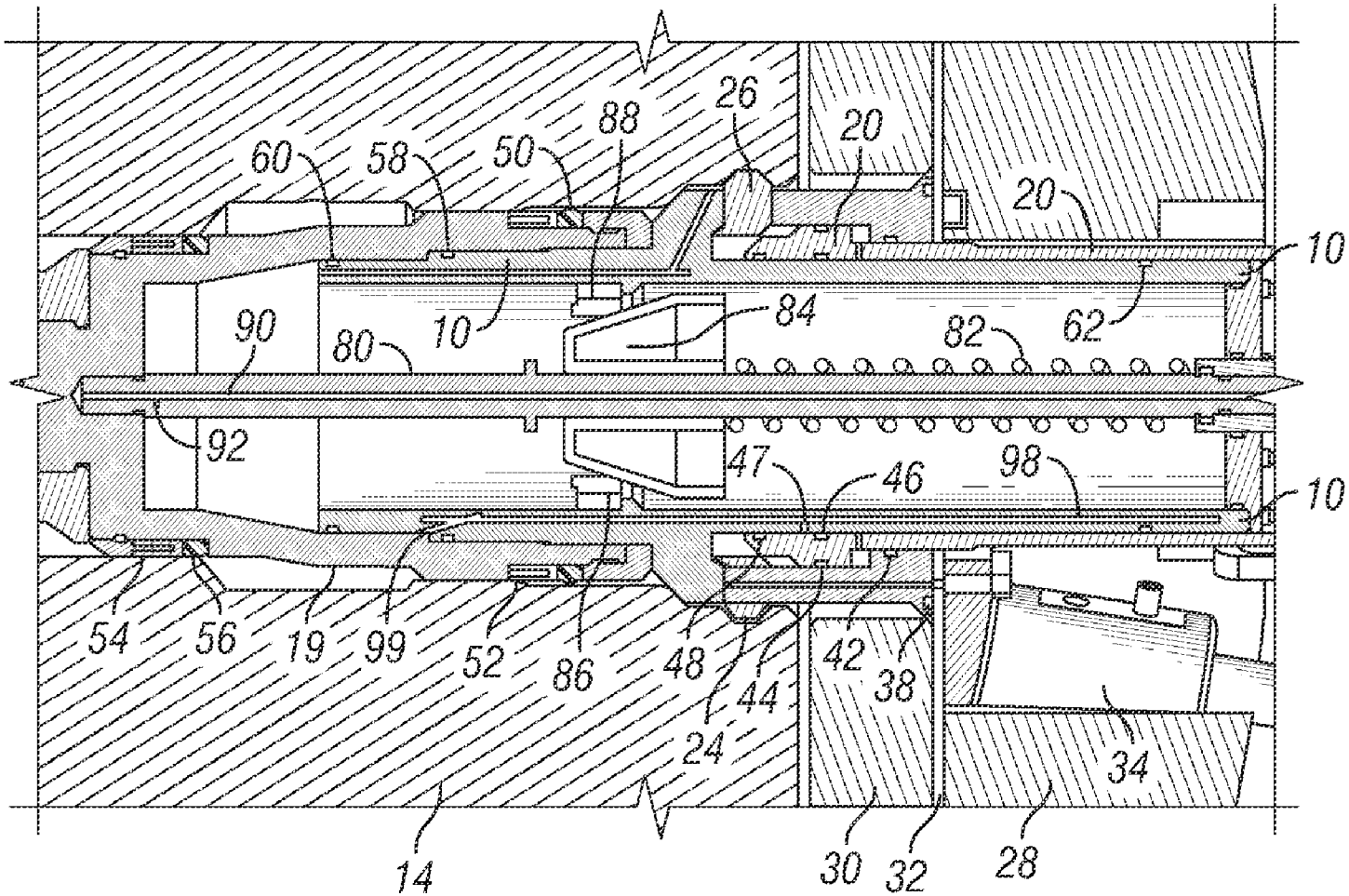
FIG. 9 shows a cross-section view of one embodiment of a tree cap locked into the subsea tree and the seal carrier in its upper position.
Figure 10:
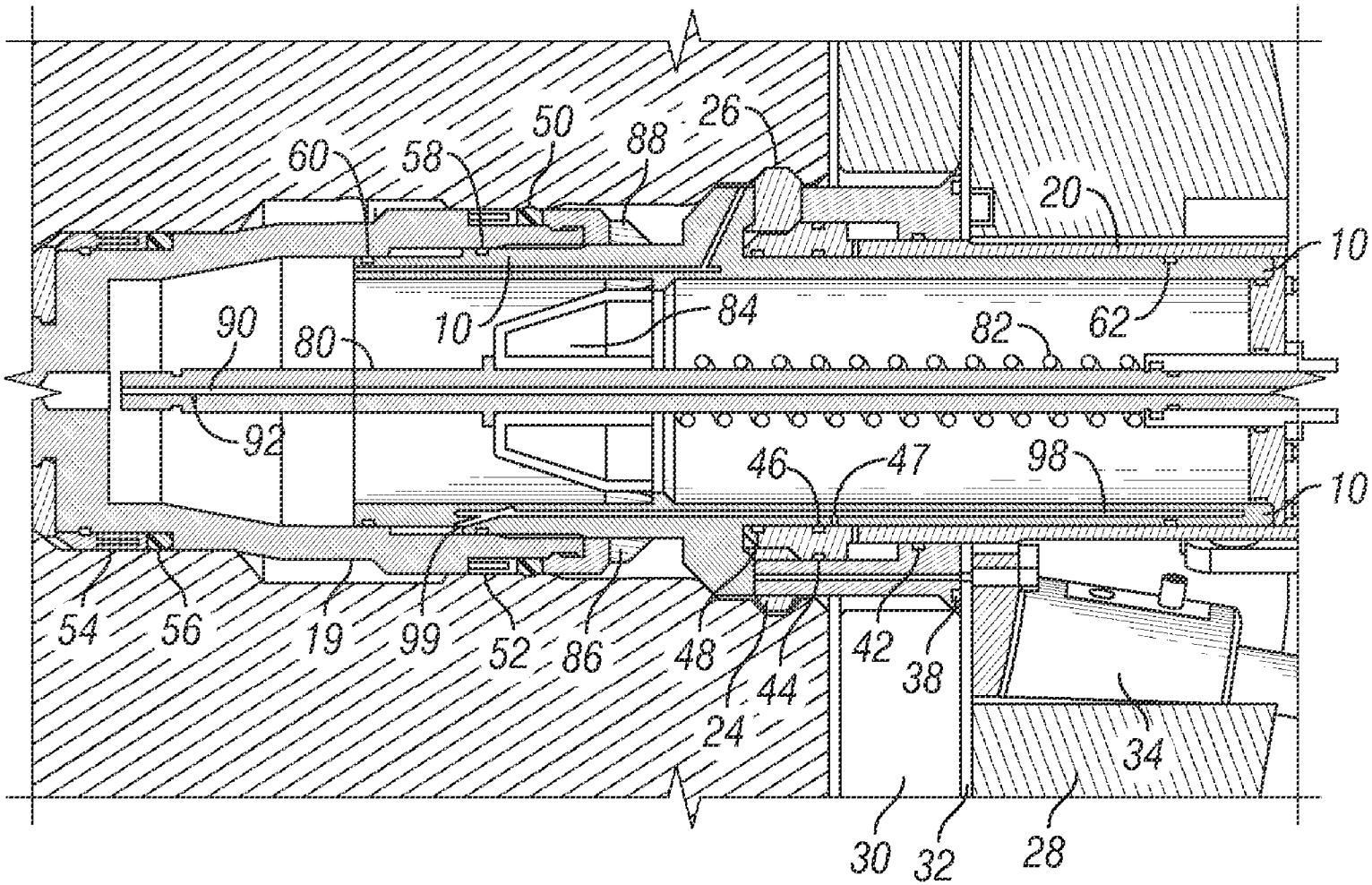
FIG. 10 shows a cross-section view of one embodiment of a tree cap locked into the subsea tree and the seal carrier in its lower position sealing the production and annulus bores of the subsea tree.

As pressure is applied from the hot stab injector it is initially contained to the cavity between the dog housing 22 and the cylindrical body 10 as seals 46, 48 isolate the upper hydraulic port 47 of the cylindrical body 10. As the piston 20 moves downwards the upper locking dogs 24, 26 are forced outwards and engage the locking profile 12 of the subsea tree 14 as shown in FIG. 9. However, the seals 46,48 may still isolate the upper hydraulic port 47 even when the upper locking dogs 24, 26 engage the locking profile 12. Additional pressure may be applied through the hot stab injector 34 to move the piston 20 downwards until the upper inner seal 46 moves past the upper hydraulic port 47 as shown in FIG. 10. At this point, the hydraulic pressure will be communicated to the lower hydraulic port 99 through the upper hydraulic port 47 and longitudinal bore 98.

Pressure from the lower hydraulic port 99 will be applied to the seal carrier 19 moving the seal carrier downwards along the cylindrical body 10. The downwards movement of the seal carrier 19 will properly position the seals 50, 52, 54, 56 of the seal carrier 19 to hydraulically isolate the production and isolation bores 16, 18. The downward movement of the seal carrier 19 will also permit the outward movement of the lower locking dogs 86, 88, which permits the spring 82 to push the cam 84 and rod 80 down the cylindrical body 10. The downward movement of the rod 80 will decrease the length of the rod 80 that protrudes from the top of the cap 79. The change in length provides an indication that the seals of the seal carrier 19 have been set within the subsea tree 14. The downward position of the cam 84 also prevents the inward movement of the lower locking dogs 86, 88, which may be used to selectively lock the seal carrier 19 in the lower or set position until it is desired to unset the seal carrier 19 and remove the tree cap 1 from the subsea tree 14.

The central longitudinal bore 90 of the rod may be used to flush or remove water trapped between the tree cap 1 and the subsea tree 14. The rod 80 includes at least one radial port 92 in communication with the longitudinal bore 90. As corrosion inhibitor is pumped into the tree cap 1 from the hot stab injector 34, trapped water may travel up the longitudinal bore 90 and out of the p-trap vent 94. The p-trap vent 94 is used to prevent water from entering the longitudinal bore 90 from the top of the rod 80.

Figure 12:
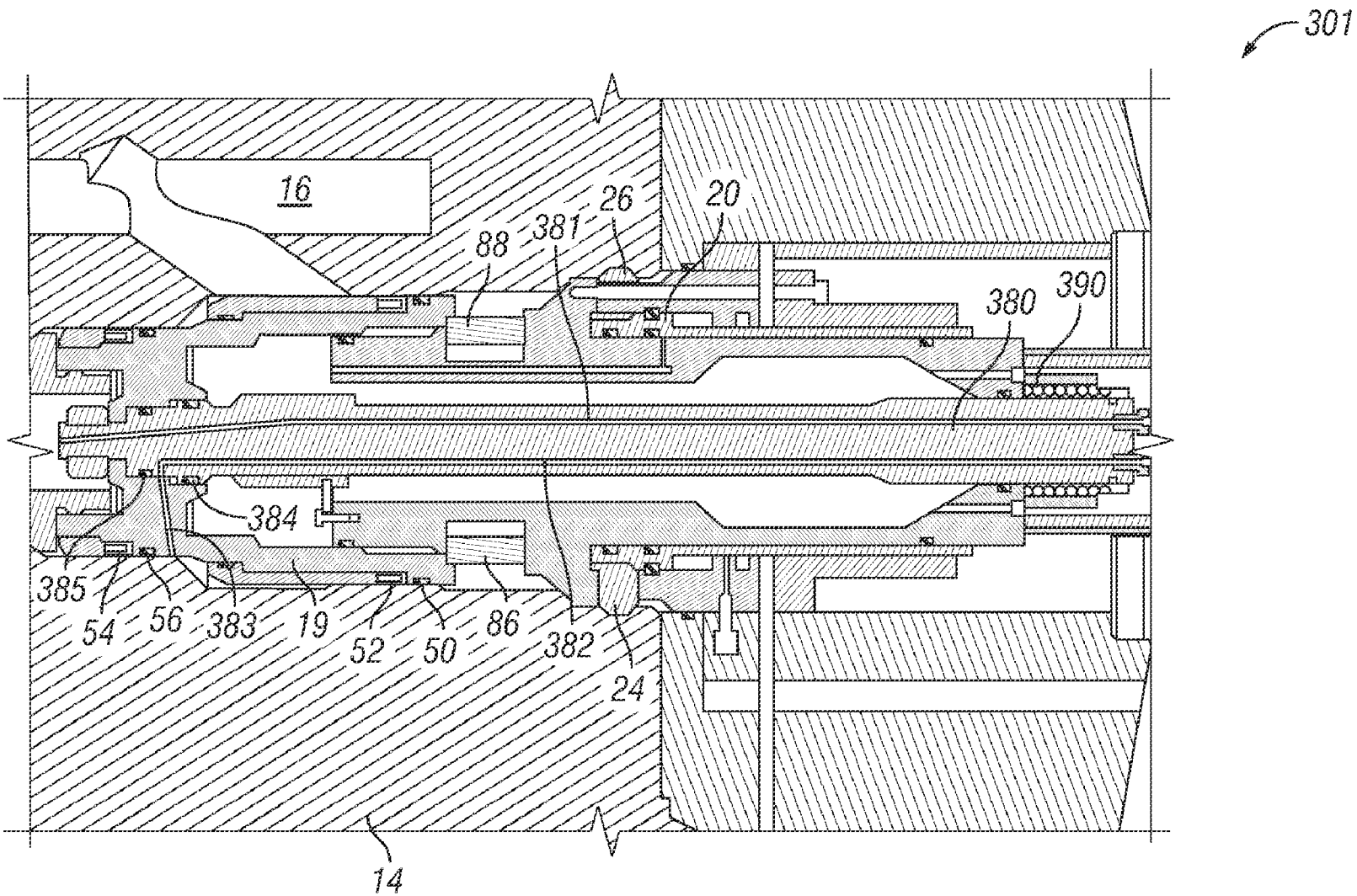
FIG. 12 shows a cross-section view of one embodiment of a tree cap that includes two flow paths through a center rod of the tree cap.

FIG. 12 shows a cross-section view of an embodiment of a tree cap 301 installed into a subsea tree 14. This embodiment of the tree cap 301 also permits the selectively locking of the tree cap 301 in the subsea tree 14 before setting the seals of the seal carrier 19. The tree cap 301 includes a rod 380 that includes two longitudinal paths 381, 382 through the rod 380. The first longitudinal path 381 is in communication below the seal carrier 19 and may be used to pressure test below the seal carrier 19. The second longitudinal path 382 is in communication with a radial bore 383 through the seal carrier 19. The radial bore 383 in combination with the second longitudinal path 382 may be used to pressure test the seal carrier seals 50, 52, 54, 56 that may be set to isolate the production and annulus bores 16, 18 of the subsea tree 14. The tree cap 301 includes a spring 390 that is used to actuate the rod 380 in a downward position. The spring 390 is positioned above the rod 380 rather than around the rod shown in the embodiment of FIG. 2. The end of the rod 380 includes sealing elements 384, 385 used to seal between the rod 380 and the seal carrier 19.

Although various embodiments have been shown and described, the invention is not so limited and will be understood to include all such modifications and variations as would be apparent to one skilled in the art.

What is claimed is:

1. A tree cap for a subsea tree having an annulus bore and a production bore, the tree cap comprising:

a cylindrical body having an upper end and a lower end, the cylindrical body having an upper fluid port in communication with a lower fluid port;

a cap connected to the upper end of the cylindrical body, the cap including an opening through the cap;

a rod positioned through the opening in the cap, the rod having an upper end above the cap and a lower end positioned within the cylindrical body;

a cam connected to the rod within the cylindrical body;

a spring positioned about the rod between the cap and the cam, the spring being biased to move the cam from an upper position to a lower position;

a lower locking dog movable between an inner position and an outer position, wherein in the inner position the lower locking dog retains the cam in its upper position;

a seal carrier slideably connected to the cylindrical body, the seal carrier being selectively movable between a first position and a second position and having an upper seal and a lower seal, wherein in the first position the seal carrier retains the lower locking dog in its inner position and in the second position the seal carrier releases the lower locking dog and the upper seal and lower seal of the seal carrier isolate the annulus bore from the production bore;

a sleeve having an upper seal and a lower seal and being slideably connected to the upper end of the cylindrical body, the sleeve being movable between a first position, a second position, and a third position, wherein in the first position and the second position the upper seal and the lower seal of the sleeve hydraulically isolate the upper fluid port of the cylindrical body;

a housing connected around the sleeve, the housing creating a cavity between the sleeve and the housing;

an upper locking dog selectively movable between an inner position and an outer position, the upper locking dog being biased to its inner position, wherein in its outer position the upper locking dog is adapted engage a profile in the subsea tree;

a plate connected to the cylindrical body;

syntactic foam connected to the plate;

a hot stab injector selectively connected to the plate and being in fluid communication with the cavity between the housing and the sleeve, wherein fluid pressure applied through the hot stab injector moves the sleeve from the first position to the second position moving the upper locking dog to its outer position;

wherein fluid pressure applied through the hot stab injector moves the sleeve from the second position to the third position moving the upper seal past the upper fluid port of the cylindrical body, the upper fluid port being in fluid communication with the cavity between the sleeve and the housing; and wherein fluid pressure applied through the hot stab injector passes through the upper fluid port to the lower fluid port and moves the seal carrier to the second position releasing the lower locking dog to move to its outer position.

2. The tree cap of claim 1, wherein a corrosion inhibitor is applied through the hot stab injector.

3. The tree cap of claim 1 further comprising a centralizer connected to the seal carrier.

4. The tree cap of claim 1, wherein the upper seal and lower seal of the seal carrier are metal-to-metal seals.

5. The tree cap of claim 4 further comprising an upper elastomeric seal adjacent the upper metal-to-metal seal and a lower elastomeric seal adjacent the lower metal-to-metal seal.

6. The tree cap of claim 1 further comprising a handle connected to the upper end of the cylindrical body, the handle being movable from an upright vertical position to a lower horizontal position.

7. The tree cap of claim 1 further comprising a longitudinal bore within the rod, wherein the longitudinal bore may be used to pressure test below the seal carrier.

8. The tree cap of claim 1 further comprising a longitudinal bore within the rod in communication with a radial bore through the seal carrier, wherein the longitudinal bore may be used to pressure test the seals of the seal carrier.

9. The tree cap of claim 1, wherein the tree cap may be installed in the subsea tree with a remotely operated vehicle.

10. The tree cap of claim 9, wherein the remotely operated vehicle may remove the hot stab injector after the seal carrier is moved to the second position.

11. The tree cap of claim 1, wherein the tree cap may be installed in the subsea tree at any radial orientation.

12. The tree cap of claim 1, wherein the distance of the upper end of the rod above the cap indicates the position of the seal carrier.

13. A tree cap for installation in a subsea tree having an annulus bore and a production bore, the tree cap comprising:

a cap;

a cylindrical body being connected to the cap;

means for selectively locking the cylindrical body to a profile in the subsea tree, wherein the locking means is hydraulically actuated;

a seal carrier slideably connected to the cylindrical body, the seal carrier being movable between a non-actuated position and an actuated position, wherein the seal carrier is adapted to hydraulically isolate the annulus bore and the production bore of the subsea tree in the actuated position;

means for hydraulically moving the seal carrier to the actuated position after locking the cylindrical body to the profile; and hydraulic injection means, wherein the means for hydraulically moving the seal carrier is configured to come into fluid communication with the hydraulic injection means only after the locking means is hydraulically actuated.

14. The tree cap of claim 13 further comprising means for selectively locking the seal carrier in the actuated position.

15. The tree cap of claim 13 wherein the tree cap may be installed into the subsea tree at any radial orientation.

16. The tree cap of claim 13 further comprising means for injecting a corrosion inhibitor into a cavity between the tree cap and the subsea tree.

17. The tree cap of claim 16 further comprising means for removing water trapped between the tree cap and the subsea tree.

18. The tree cap of claim 13, wherein the hydraulic injection means is a hot stab injector, and wherein fluid pressure from the hot stab injector first actuates the locking means and then moves the seal carrier to the actuated position.

19. A method for installing a tree cap on a subsea tree, the method comprising:

moving the tree cap to the subsea tree with a remotely operated vehicle;

inserting the tree cap into a bore in the subsea tree;

applying fluid pressure to the tree cap with a hot stab injector selectively connected to the tree cap;

locking the tree cap into the subsea tree, wherein locking dogs are engaged by the fluid pressure from the hot stab injector; and setting seals of the tree cap to isolate an annulus bore and production bore of the subsea tree, wherein the seals are set after locking the tree cap into the subsea tree.

20. The method of claim 19 further comprising injecting a corrosion inhibitor through the hot stab injector into a cavity between the tree cap and the subsea tree.

21. The method of claim 20 further comprising removing water trapped between the tree cap and the subsea tree.

22. The method of claim of claim 19 further comprising moving a handle of the tree cap with the remotely operated vehicle from a vertical position to a horizontal position.

23. The method of claim 19 further comprising removing the hot stab injector with the remotely operated vehicle.

24. The method of claim 19, wherein the tree cap may be inserted at any radial orientation into the bore of the subsea tree.

25. The method of claim 19, wherein fluid pressure from the hot stab injector sets the seals of the tree cap.

26. A tree cap fur use with a subsea tree having a concentric bore, the tree cap comprising:

a cylindrical body having a top end and a bottom end;

a cap connected to the top end of the cylindrical body;

a seal carrier slideably connected to the bottom end of the cylindrical body movable between an upper position and a lower position, the seal carrier including a plurality of seals adapted to seal the concentric bore of the subsea tree in the lower position of the seal carrier a first locking means connected to the cylindrical body, the first locking means being adapted to selectively engage a profile in the concentric bore of the subsea tree, wherein the first locking means is adapted to engage the profile of the concentric bore for any radial orientation of the cylindrical body;

a second locking means connected to the cylindrical body, the second locking means being adapted to selectively retain the seal carrier in the lower position; and a hot stab injector, wherein fluid pressure from the hot stab first actuates the first locking means and then moves the seal carrier to the lower position, wherein the second locking means selectively retains the seal carrier in the lower position.

27. The tree cap of claim 26 further comprising a plate connected to the cylindrical body, an upper portion of syntactic foam connected to an upper portion of the plate, and a lower portion of syntactic foam connected to a lower portion of the plate.

* * * * *

UNITED STATES PATENT AND TRADEMARK OFFICE

CERTIFICATE OF CORRECTION

PATENT NO. : 7,677,319 B2
APPLICATION NO. : 11/873206
DATED : March 16, 2010
INVENTOR(S) : Baskett It is certified that error appears in the above-identified patent and that said Letters Patent is hereby corrected as shown below:

Col. 5, line 18 should read
the seal carrier in the lower position, “It” --In-- the lower position, the
Col. 12, lines 6-8, claim 22 should read
22. The method “of claim” of claim 19 further comprising moving a handle of the tree cap with the remotely operated vehicle from a vertical position to a horizontal position.
Col. 12, lines 16-38, claim 26 should read
26. A tree cap “fur” --for-- use with a subsea tree having a concentric bore, the tree cap comprising:
a cylindrical body having a top end and a bottom end;
a cap connected to the top end of the cylindrical body;
a seal carrier slideably connected to the bottom end of the cylindrical body movable between an upper position and a lower position, the seal carrier including a plurality of seals adapted to seal the concentric bore of the subsea tree in the lower position of the seal carrier
a first locking means connected to the cylindrical body, the first locking means being adapted to selectively engage a profile in the concentric bore of the subsea tree,
wherein the first locking means is adapted to engage the profile of the concentric bore for any radial orientation of the cylindrical body;
a second locking means connected to the cylindrical body, the second locking means being adapted to selectively retain the seal carrier in the lower position; and
a hot stab injector, wherein fluid pressure from the hot stab first actuates the first locking means and then moves the seal carrier to the lower position, wherein the second locking means selectively retains the seal carrier in the lower position.

Signed and Sealed this
Second Day of August, 2011

David J. Kappos

David J. Kappos
*Director of the United States Patent and Trademark Office*